US010337701B2

(12) United States Patent
Mastenbroek et al.

(10) Patent No.: US 10,337,701 B2
(45) Date of Patent: Jul. 2, 2019

(54) DECORATIVE LED INTEGRATED LUMINAIRE

(71) Applicant: SIGNIFY HOLDING B.V., Eindhoven (NL)

(72) Inventors: Olaf Mastenbroek, Eindhoven (NL); Yves Roger Herremans, Eindhoven (NL); Herman Jozef Godfried Goris, Eindhoven (NL); Denis Joseph Carel Van Oers, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/312,642

(22) PCT Filed: May 7, 2015

(86) PCT No.: PCT/EP2015/060006

§ 371 (c)(1),
(2) Date: Nov. 19, 2016

(87) PCT Pub. No.: WO2015/176960

PCT Pub. Date: Nov. 26, 2015

(65) Prior Publication Data

US 2017/0205052 A1 Jul. 20, 2017

(30) Foreign Application Priority Data

May 21, 2014 (EP) ..... 14169317

(51) Int. Cl.

| | |
|---|---|
| ***F21S 8/06*** | (2006.01) |
| ***F21V 3/00*** | (2015.01) |
| ***F21V 17/00*** | (2006.01) |
| ***F21V 23/00*** | (2015.01) |
| ***F21V 23/06*** | (2006.01) |

(Continued)

(52) U.S. Cl.

CPC ..... *F21V 17/002* (2013.01); *F21S 8/061* (2013.01); *F21V 3/00* (2013.01); *F21V 23/001* (2013.01); *F21V 23/005* (2013.01); *F21V 23/06* (2013.01); *F21W 2121/00* (2013.01); *F21Y 2115/10* (2016.08)

(58) Field of Classification Search

CPC ..... F21S 8/04; F21S 8/043; F21S 8/06; F21S 8/061; F21S 8/063; F21V 17/002

See application file for complete search history.

(56) References Cited

U.S. PATENT DOCUMENTS

| | | | | |
|---|---|---|---|---|
| 2,675,466 A | | 4/1954 | Baker | |
| 5,951,145 A | * | 9/1999 | Iwasaki | F21S 8/04 362/216 |

(Continued)

FOREIGN PATENT DOCUMENTS

| | | | |
|---|---|---|---|
| CA | 2507081 | A1 | 11/2006 |
| CN | 102575838 | A | 7/2012 |

(Continued)

*Primary Examiner* — Alexander K Garlen

(57) ABSTRACT

A luminaire is provided, the luminaire is fitted with a decorative element (3) that is simple to exchange for a user without the need for additional tooling. Further, a range of optical structures (2) are provided that enable the user to easily tailor the light distribution generated by his luminaire without having to purchase an entire new luminaire.

17 Claims, 6 Drawing Sheets

(51) Int. Cl.
*F21W 121/00* (2006.01)
*F21Y 115/10* (2016.01)

(56) References Cited

U.S. PATENT DOCUMENTS

| | | | | |
|---|---|---|---|---|
| 7,762,711 | B2 * | 7/2010 | Tseng | F21K 9/00 362/311.02 |
| 8,454,204 | B1 | 6/2013 | Chang et al. | |
| 2005/0201082 | A1 * | 9/2005 | Mauk | F21S 8/033 362/147 |
| 2011/0170294 | A1 | 7/2011 | Mier-Langner et al. | |
| 2011/0242815 | A1 * | 10/2011 | Markle | F21S 8/06 362/294 |
| 2014/0104844 | A1 | 4/2014 | Fereydouny | |
| 2014/0268742 | A1 * | 9/2014 | Feit | F21V 1/00 362/235 |
| 2017/0016599 | A1 * | 1/2017 | Wang | F21S 9/03 |
| 2017/0205052 | A1 * | 7/2017 | Mastenbroek | F21V 17/002 |

FOREIGN PATENT DOCUMENTS

| | | | |
|---|---|---|---|
| CN | 203010273 | | 6/2013 |
| CN | 103335264 | A | 10/2013 |
| CN | 103453423 | A | 12/2013 |
| DE | 202012003111 | U1 | 5/2012 |
| EP | 2439445 | A2 | 4/2012 |
| GB | 246526 | A | 4/1927 |
| JP | 0369811 | A | 3/1991 |
| JP | 2008071604 | A | 3/2008 |
| JP | 2009295368 | A | 12/2009 |
| JP | 3185789 | U | 9/2013 |
| JP | 2014053109 | A | 3/2014 |
| RU | 2009118422 | A | 11/2010 |
| RU | 127869 | U1 | 5/2013 |
| WO | 2008067515 | A1 | 6/2008 |
| WO | 2014021456 | A1 | 2/2014 |

* cited by examiner

DECORATIVE LED INTEGRATED LUMINAIRE

CROSS-REFERENCE TO PRIOR APPLICATIONS

This application is the U.S. National Phase application under 35 U.S.C. § 371 of International Application No. PCT/EP2015/060006, filed on May 7, 2015, which claims the benefit of European Patent Application No. 14169317.6, filed on May 21, 2014. These applications are hereby incorporated by reference herein.

FIELD OF THE INVENTION

The invention relates to luminaires and in particular to decorative elements, for example to provide a user with an easily changeable decorative element.

BACKGROUND OF THE INVENTION

To reduce harsh and glaring light emitted by a luminaire a decorative element may be used. The decorative element may shield part or all of the luminaire to reduce glare. The decorative element may also serve an aesthetic purpose too.

US2011170294 discloses a luminaire having a base, the base includes a heat sink and a primary LED module. There is one of a plurality of interchangeable decorative elements disposed against the luminaire base. The decorative element is fixed in place with one of a plurality of interchangeable collar assemblies.

SUMMARY OF THE INVENTION

It would be advantageous to achieve a luminaire having a decorative element that is easy to change. It would also be desirable to provide a user with a range of optical structures to suit a particular decorative element. To better address one or more of these concerns, in a first aspect of the invention, there is provided a luminaire, comprising:

a LED light engine for emitting light, an optical structure positioned to receive the light emitted, and a decorative element, wherein said decorative element is removably located proximate to said light engine by said optical structure and said decorative element is changeable by a user to provide configurable light output characteristics.

This arrangement enables the light emitted by the light engine to be configured by a user to suit their particular application. In one embodiment the optical structure may be arranged to provide a narrow spot type beam pattern and a different optical structure may be arranged to provide a wide flood type beam pattern. In another embodiment the decorative element may be changed in order to optimize the beam pattern, for example, a narrow angle decorative element to suit an optical structure that provides a spot type beam pattern and a wider angle decorative element to suit an optical structure that provides a flood type beam. Such optical elements are well known in the field, the trend within LED luminaires is to manufacture a product that by virtue of the longevity of the LEDs within need not be user serviceable. Indeed on a frequent basis luminaires are seen that have LED light engines that are overmolded with the optical elements. This means that if the user changes the functionality of part of their room, for example, from a sitting area to a dining area the lighting requirements may well be different for the two uses and the luminaire and more specifically the optical element or structure may well be unsuited for the new lighting requirements.

It would be advantageous to offer the user a luminaire in which the optical structure can be changed to suit a new lighting requirement and that the optical structure removably locates a decorative element. The decorative element may be changed by a user when the decor of the room is changed or again, to suit a new lighting requirement. A narrow angle decorative element or taken to an extreme, cylindrical decorative element with a light engine at one end will produce a concentrated spot of light on the object that is illuminated. This is because the shape of the decorative element will reflect light internally that is emitted at an angle greater than the angle of the sides of the decorative element relative to the light engine. That is to say, if the decorative element chosen by the user is, for example, a cylinder with the light engine located at one end emitting light into the cylinder then the light emitted by the light engine at angles greater than substantially parallel to the normal of the light engine will impinge on the internal wall of the cylinder and be reflected. This effect can be tailored in multiple ways, the first and most simple way is to adjust the length of the cylinder. A short cylinder will have less light rays impinge upon it than a long cylinder, a greater range of angularly emitted light will exit then in a longer cylinder where a narrower angular range of light emitted does not impinge on the inside of the cylinder.

It can also be seen that a wider angle decorative element may not have an effect on the angular range of the light emitted by the luminaire if the optical structure is designed to narrow or collimate the light emitted by the light engine. It can be seen that all combinations are possible but in most cases it is probable that a user would wish to tailor both the decorative element and the optical structure to the desired light output requirements.

The invention also provides a method of installing a luminaire, the method comprising:

installing a base component of a fixing in the desired location, installing one portion of at least one connector to the electrical supply located at the desired location, selecting a decorative element that provides configurable light output characteristics, locating said decorative element proximate to a light engine, securing said decorative element proximate to said light engine using a removably attachable optical structure, connecting at least one mechanical and electrical connection at the desired location, covering the at least one connection with a decorative cover.

These and other aspects of the invention will be apparent from and elucidated with reference to the embodiment(s) described hereinafter, the sequence of the steps disclosed is not essential.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a luminaire. A decorative element may be secured in a position proximate to a light engine by an optical structure.

Figure 1:
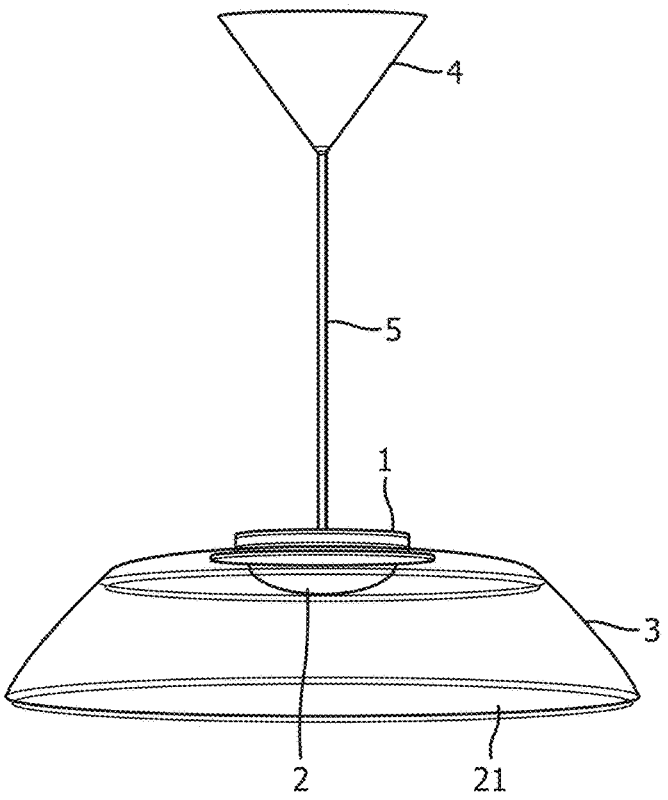
FIG. 1 shows a luminaire in accordance with an embodiment of the invention.

FIG. 1 shows a luminaire comprising a light engine 1, an optical structure 2, a decorative element 3, a decorative cover 4, and an electrical wire 5.

The light engine 1 comprises at least one LED, in the example shown an electrical driver and the at least one LED are mounted on a common circuit board.

The optical structure 2 provides optical management of the light emitted by the LED light engine and secures the decorative element 3 in a position proximate to the light engine 1.

A decorative cover 4 may be provided; this cover may conceal the electrical and/or mechanical connections between the light engine 1 and the desired fixing location of the luminaire.

In the example shown the light engine 1 is located at a remote location from the decorative cover 4 and an electrical wire 5 is provided to provide an electrical path between the electrical connection concealed by the decorative cover 4 and the light engine 1.

Figure 2:
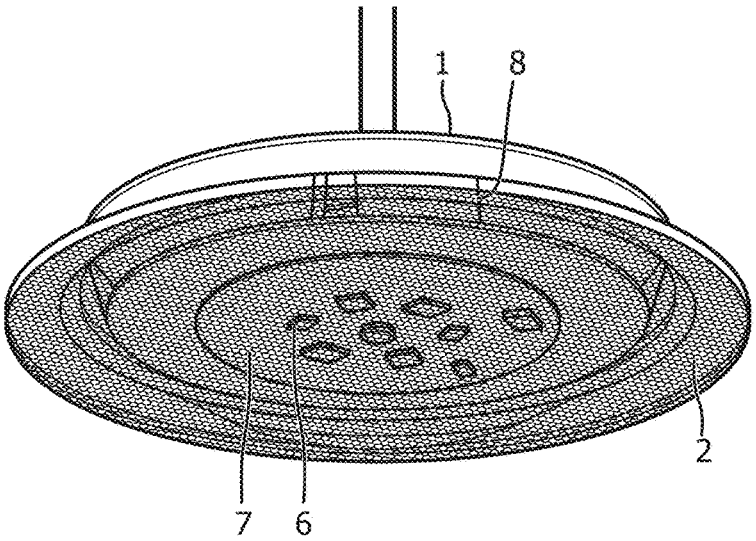
FIG. 2 shows a light engine and optical structure in accordance with an embodiment of the invention.

FIG. 2 shows a light engine 1 and an optical structure 2. In the example shown, the LEDs 6 are mounted on a Printed circuit board (PCB) 7. Also mounted on this PCB 7 is the electrical driver 8. The advantage of mounting the driver 8 and the LEDs 6 on a common PCB 7 is that this sub assembly has a small form factor and can be incorporated in smaller LED light engines 1.

The light engine 1 is designed to be a standardized part, that is to say that it is a single design that can be utilized in a range of luminaires. The optical structure 2 may be changed for another optical structure that offers different optical management properties. This allow the user to modify the light output characteristics of his luminaire by simply removing the optical structure 2 from the light engine 1 and replacing with a different optical structure 2. In the example shown the light engine 1 does not have any additional cooling mechanisms such as, for example a heat sink as the PCB 7 radiates the heat generated by the LEDs 6 and the electrical driver 8 via the optical structure 2.

Figure 3:
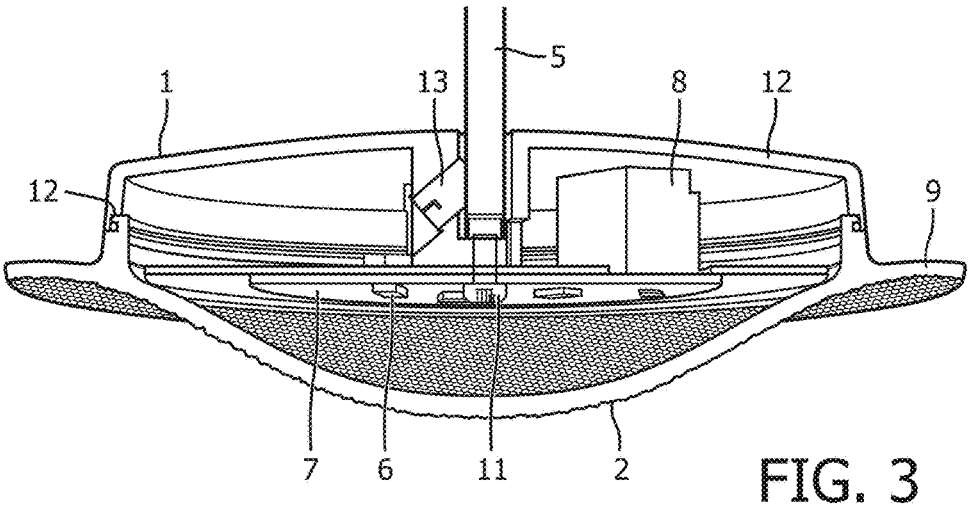
FIG. 3 shows a cut away view of a light engine and optical structure in accordance with an embodiment of the invention.

FIG. 3 shows a cut away view of a light engine 1 according to an embodiment of the invention. In this example, the optical structure 2 is dished in order to homogeneously spread the light emitted by the LEDs 6 over a wide viewing angle. This optical structure 2 has the advantage of creating multiple secondary light source images; this will give the viewer the impression of a more or less uniform light source behind the optical structure 2. The optical structure 2 could also be a diffuser; such a diffuser would also create the visual impression of a more or less homogenous light source, furthermore, the optical structure 2 may be a lens and/or a reflector.

The LED(s) 6 are mounted on a common PCB 7 with the electrical driver 8. In this example, the PCB 7 is attached to the housing 12 by a mechanical fastener, e.g. a screw 11. The light engine 1 is also attached in this example to the electrical wire 5 by a mechanical fastener, e.g. a grub screw 13.

In the embodiment shown in FIG. 3, the optical structure 2 has a protruding, annular portion 9 extending around its circumference. The purpose of this annular portion 9 is to support the decorative element 3. The decorative element could be manufactured with a circular hole that is designed to cooperate with the light engine 1, i.e. the circular hole may have a diameter larger than the diameter of the housing 12 but smaller than the diameter of the annular portion 9, this would mean that if the decorative element was located above the annular portion that it would be free to move in a upwards vertical direction but it would not be able to move in a downwards vertical direction.

The optical structure 2 as shown in FIG. 3 has a fixing 10, in this example this fixing 10 may comprise a screw thread designed to cooperate with a matching screw thread in the housing 12. It is also possible to complete the attachment of the optical structure 2 to the housing 12 in other ways, for example, a snap fitting wherein the fixing 10 is of a slightly larger diameter than the internal diameter of the housing 12. The fixing 10 of the optical structure 2 or the housing 12 may be made of a resilient but deformable medium such as a plastic. This will allow the deformable part to return to its original diameter once the external force has been removed. This is known as plastic deformation. A small residual force may be exerted and this will keep the deformable part in the plastic deformation zone and may result in a more secure snap fit as the both parts exert a small force upon each other. These types of snap fits may allow a secure fit that is still easy for the user to assemble and disassemble with no need for additional tooling, they are also designed to be assembled and disassembled frequently with no noticeable degradation in fit quality.

The fixing 10 of the optical structure 2 to the housing 12 could be achieved with the use of magnets; these could either be of the permanent magnet type or the electromagnetic type. If a permanent type magnet is used, it may be advantageous to insert ferritic elements in the other cooperating part, for example if magnets were used in the fixing 10 of the optical structure 2 it may be advantageous to insert ferric elements in the housing 12 so that the two parts were magnetically attracted to each other. An electromagnetic fastening may function in a broadly similar way to that of the permanent magnet type of fixing however when power is no longer supplied to the electromagnet the attraction will be removed thus enabling the optical structure 2 to be removed from the housing 12.

Figure 4:
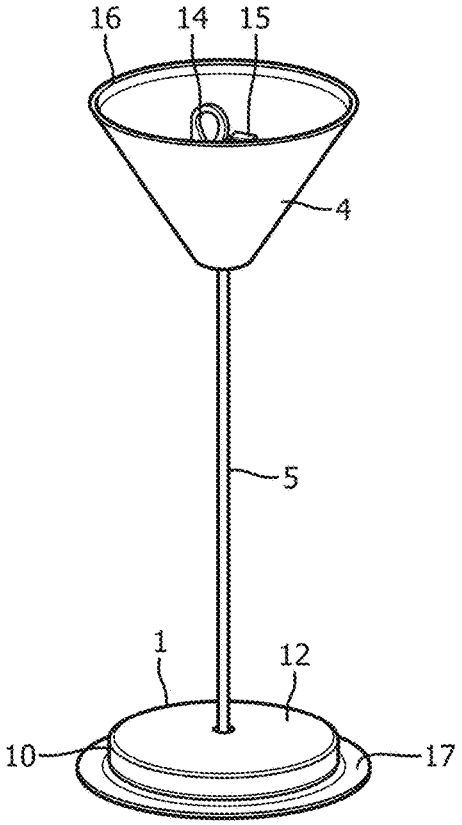
FIG. 4 shows a view of a light engine, a fixing and a decorative cover in accordance with an embodiment of the invention.

FIG. 4 shows an embodiment of the invention, in this example the decorative cover 4 is shown in the final position, i.e. the edge 16 may rest against the surface of the desired fixing location, this may be a ceiling, the underside surface of a horizontal surface, for example a shelf etc. The purpose of the decorative cover 4 is to provide a more aesthetic finish to the overall luminaire by concealing the fixing. In this example both a mechanical connection 14 and electrical connection 15 is provided. In other embodiments (not shown) only the electrical connection 14 is provided, mechanical support is achieved by the electrical connection 15 and the electrical wire 5. In the example shown, a mechanical connection 14 is an eyelet that cooperates with a hook type fixing at the desired location. Other examples of the mechanical connection 14 include, but are not limited to snap fittings, a slideable bolt and hasp or any other type of two or more piece fittings. It is advantageous to use at least a two part mechanical connection 14 as this allows the user to removably attach the luminaire in the desired location.

In the example shown in FIG. 4, the decorative cover 4 has a smaller diameter than the annular portion 17 of the housing 12. The annular portion 17 is part of the housing 12 in this embodiment and not part of the optical structure 2. This embodiment allows the user to move the decorative cover 4 in a downwards direction along the electrical cable 5, this will provide access to the mechanical connection 14 and the electrical connection 15. Advantageously, the electrical connection 15 is a Mate-N-Lok® connector allowing the swift and safe disconnection of the power supply to the luminaire. Alternatively a screw terminal block may be used.

Once the electrical wire 5 is disconnected from the power the mechanical connection 14 can be disconnected allowing the luminaire to be lowered from the fixing location. The decorative element 3 (not shown) can be maneuvered past the decorative cover 4, the electrical connection 15 and the mechanical connection 14. Once the decorative element 3 is clear of the luminaire it may be changed by the user for a different decorative element 3. The decorative element 3 to be fitted is maneuvered past the mechanical connection 14, the electrical connection 15 and the decorative cover 4. The decorative element 3 may have a circular through hole that is larger in diameter than the small diameter 18 of the housing 12 but smaller than the diameter of the annular portion 17 of the housing 12. The decorative element 3 will be supported in position by the annular portion 17 of the housing 12. The user then connects the electrical connection 15 and the mechanical connection 14 and conceals the connections with the decorative cover 4.

This allows the user to select an optical structure 2 that offers a different light distribution and to fit this optical structure 2 to his existing light engine 1 to obtain the desired light distribution characteristics without having to change the entire luminaire. This brings time and financial benefits to the user and environmental benefits to society as a whole as large parts of the luminaire are not discarded when a different light distribution is desired by the user.

Figure 5:
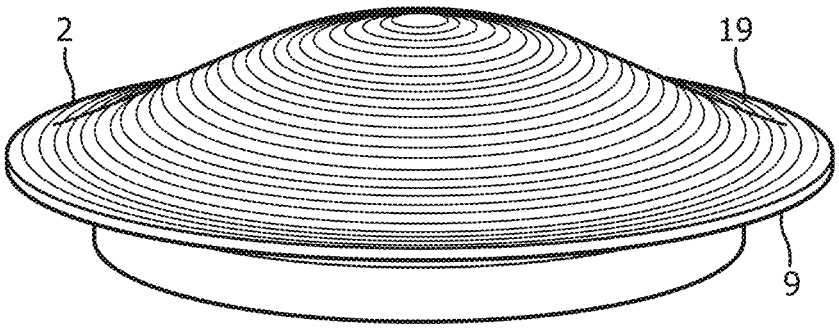
FIG. 5 shows a view of an external structure of an optical structure according to an embodiment of the invention.

FIG. 5 shows an embodiment of an optical structure 2. In this example, the external surface 19 comprises a series of concentric ridges extending in an axial direction. The protruding annular portion 9 for supporting the decorative element 3 (not shown) is also visible.

Figure 6:
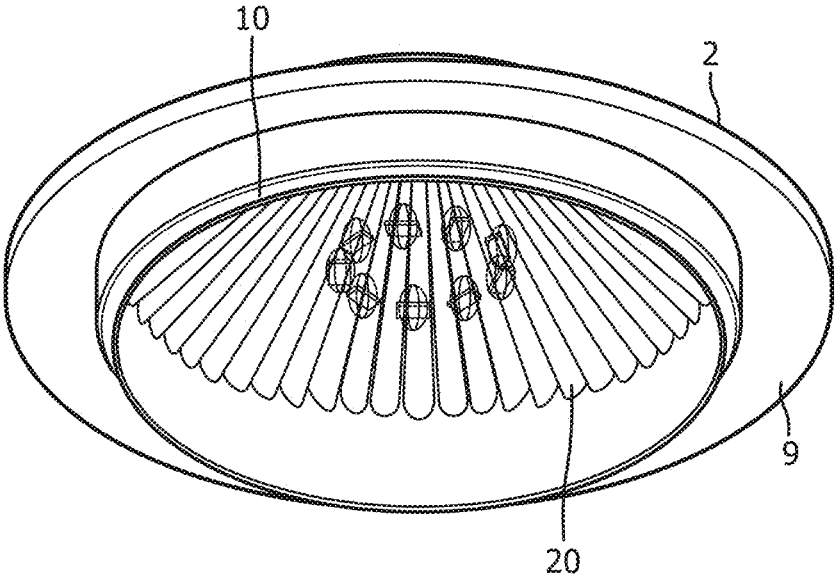
FIG. 6 shows a view of an internal structure of an optical structure according to an embodiment of the invention.

FIG. 6 shows an embodiment of an optical structure 2. In this example, the internal surface 20 of the optical structure 2 comprises a series of radial ridges extending outwards towards the protruding annular portion 9 from a central point. The fixing 10 of the optical structure 2 is shown, this fixing secures the optical structure 2 to the housing 12 of the light engine 1.

Figure 7:
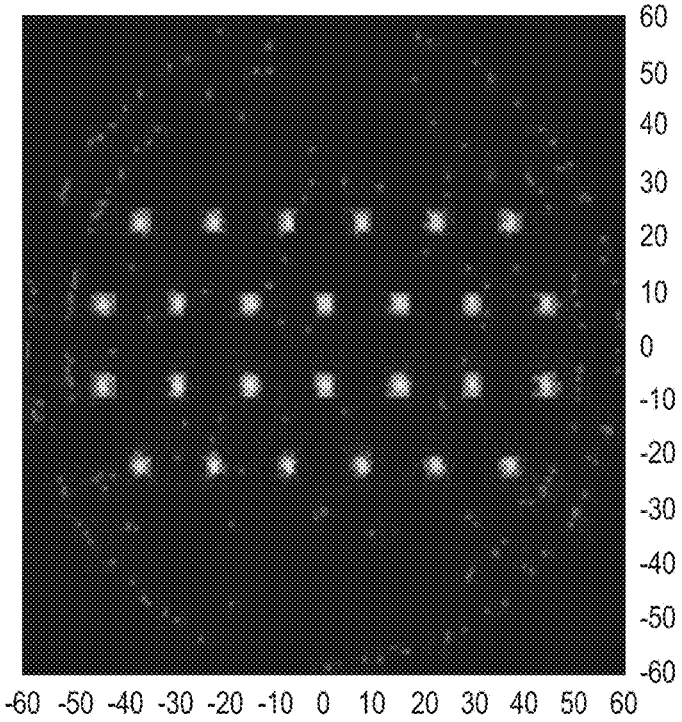
FIG. 7 shows a simulated view of the luminance generated by a 26 LED array without an optical structure according to an embodiment of the invention.

FIG. 7 shows a simulated view of the luminance generated by an array of 26 LEDs 6 according to an embodiment of the invention. In this example, the light emitted by the LEDs 6 does not pass through an optical structure. The individual point sources of light are high luminance that can be clearly seen and may be perceived as irritating by an observer.

Figure 8:
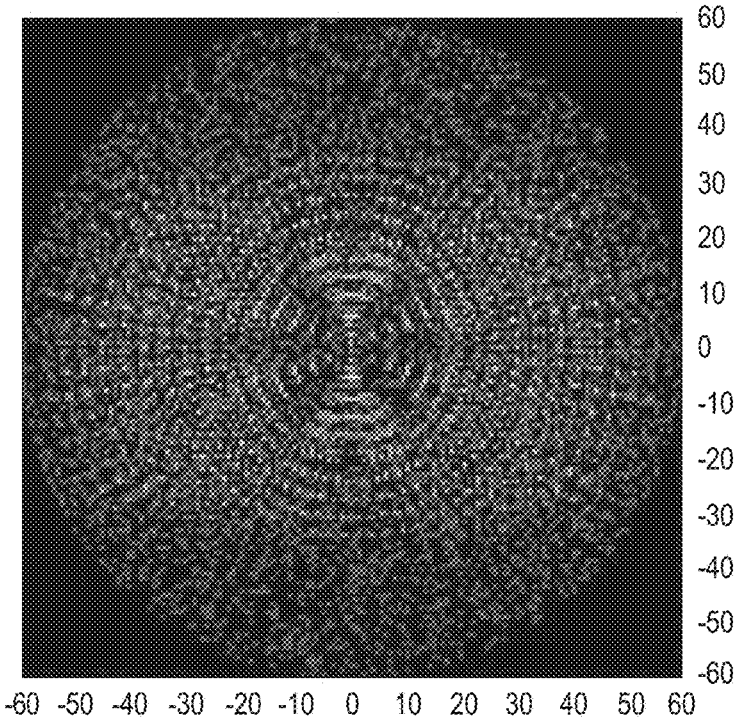
FIG. 8 shows a simulated view of the luminance generated by a 26 LED array with an optical structure according to an embodiment of the invention.

FIG. 8 shows a simulated view of the luminance generated by an array of 26 LEDs 6 according to an embodiment of the invention. In this example, the light emitted by the array of LEDs 6 passes through the optical structure 2 shown in detail in FIGS. 5 and 6. It can be seen that the optical structure 2 comprising a combination of axial lenses and radial lenses results in an optical structure that multiplies the LED 6 images and therefore an observer will have the visual impression that there is an equalized luminance distribution across the surface 19 of the optical structure 2. This equalized distribution will reduce the irritation to the observer as they are no longer able to see the individual high luminance point sources of light.

Figure 9:
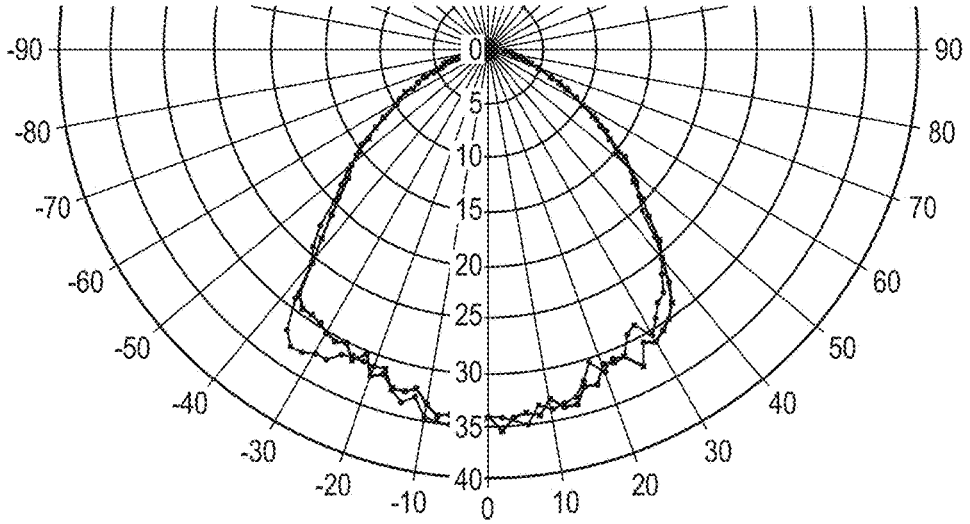
FIG. 9 shows a polar diagram of a light output generated by a light engine and emitted through an optical structure in accordance with an embodiment of the invention.

FIG. 9 shows a polar plot of the light distribution of the light emitted by the LEDs 6 after passing through the optical structure 2 shown in FIGS. 5 and 6 according to an embodiment of the invention. This shows that the light output is more concentrated in the middle of the optical structure 2 and as such is suitable for overall lighting with a good light distribution for task lighting underneath the luminaire. Other optical structures 2 may be utilized for different light distributions that are desired by the user.

Figure 10:
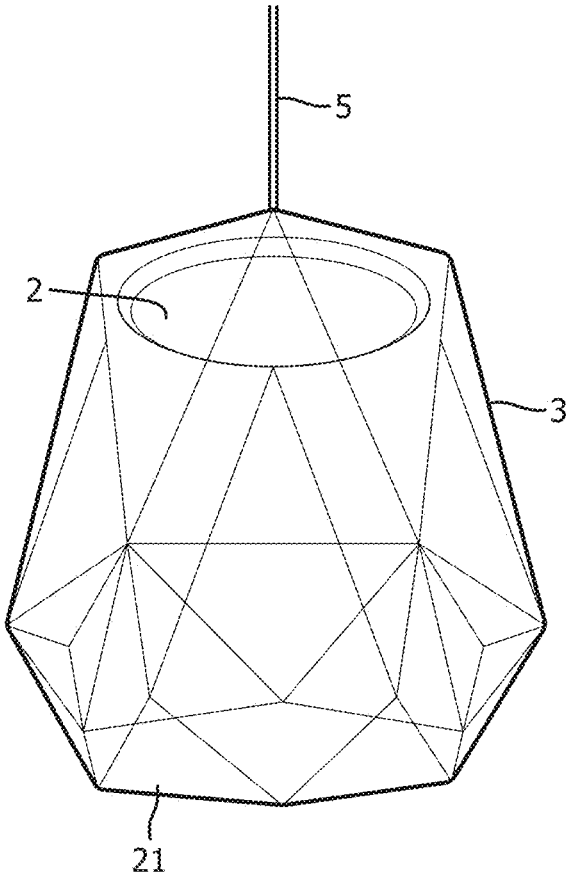
FIG. 10 shows a view of a decorative element according to an embodiment of the invention.

FIG. 10 shows an embodiment of the decorative element 3. The decorative element 3 can serve a functional purpose as well as an aesthetic purpose. This can be achieved in a variety of ways. If the decorative element 3 is opaque then the light emitted by the light engine 1 that passes through the optical structure 2 and impinges on the inner surface of the decorative element 3 will be reflected and will exit the decorative element 3 by the exit window 21.

The decorative element 3 can be manufactured with a specular or diffuse inner reflectance, a diffuse reflectance may improve the mixing of the light and so if the decorative element has a wide angle (with respect to the normal of the decorative element 3) and a large exit window 21 then the light emitted by the luminaire will be homogenous.

The decorative element 3 may be transparent and it may also have a micro structure on the inner surface. This micro structure may be designed to reflect the light emitted by the light engine 1 that has passed through the optical structure 2 and is impinging on the decorative element 3; this is known as total internal reflection (TIR).

In another embodiment of the invention, the decorative element 3 may be tailored to the optical structure 2, e.g. the consumer can purchase a decorative element 3 and optical structure 2 that provides a desired light output characteristic from the luminaire. The consumer may wish to purchase an optical structure 2 and decorative element 3 that provide a narrow spot type beam pattern for focused task lighting or they may wish to purchase an optical structure 2 and decorative element 3 that provide a flood type beam pattern for general illumination.

The decorative element may be manufactured from any material that provides the desired optical or aesthetic characteristics. This can include, for example but not limited to, plastics, ceramics, glass or metals. These can be formed by conventional manufacturing techniques, for example, injection molding, cast molding, lost wax casting, drawing, spinning, machining, turning, glass blowing, or they may be manufactured using additive manufacturing, that is to say 3D printing. Additive manufacturing offers numerous benefits when the decorative element 3 is complex or a consumer wishes to purchase a unique or low volume luminaire.

The invention claimed is:

1. A luminaire comprising;

a LED light engine for emitting light, an optical structure positioned to receive the light emitted and to modify the emitted light's characteristics, and a decorative element;

wherein, said optical structure is utilized to removably attach said decorative element proximate to said light engine and said decorative element is intended to be changed by a user to provide configurable light output characteristics; and, wherein the optical structure has a circumference and a protruding, annular portion extending around the circumference; the decorative element comprises a circular hole corresponding to the LED light engine, the circular hole having a diameter larger than a largest diameter of a housing containing said LED light engine and smaller than a diameter of the annular portion; whereby in use, the annular portion; supports the decorative element.

2. A luminaire according to claim 1 wherein said optical structure comprises a diffuser for diffusing the light emitted by said light engine.

3. A luminaire according to claim 1 wherein said optical structure comprises at least one of a lens and a reflector for directing the light emitted by said light engine.

4. A luminaire according to claim 3 wherein at least one of said lens and said reflector is arranged to manage a beam shape of the light emitted from said light engine to correspond with said decorative element.

5. A luminaire according to claim 1 wherein said light engine comprises at least one LED.

6. A luminaire according to claim 1 further comprising a housing, said housing located proximate to said light engine, said optical structure and said decorative element, wherein;

said optical structure is removably attached to the housing.

7. A luminaire according to claim 6 wherein the optical structure is mechanically attached to said housing.

8. A luminaire according to claim 1 wherein the luminaire further comprises a fixing for attaching the luminaire in a desired location, said fixing comprising at least one mechanical and electrical connection, said at least one mechanical and electrical connection being accomplished by connectors that can be removably connected without additional tooling.

9. A luminaire according to claim 8, said luminaire further comprising;

an electrical wire, and a mechanical support wire, said electrical wire providing an electrical path between said at least one electrical connection and said light engine, said mechanical support wire providing a mechanical connection between said fixing and said light engine, wherein said light engine is in a remote location from said at least one of electrical and mechanical connections.

10. A luminaire according to claim 8, said luminaire further comprising an electrical wire, said electrical wire providing an electrical path between said at least one electrical connection and said light engine, said at least one electrical connection and electrical wire further providing a mechanical connection between said fixing and said light engine wherein said light engine is in a remote location from said electrical connection.

11. A luminaire according to claim 9 arranged to add said decorative element to said luminaire wherein, said electrical wire is removably attached to said at least one electrical connection, said mechanical support wire is removably attached to said at least one mechanical connection, said decorative element is removably attached to said optical structure.

12. A luminaire according to claim 10, arranged to add said decorative element to said luminaire wherein;

said electrical wire is removably attached to said at least one electrical connection, and said decorative element is removably attached to said optical structure.

13. A luminaire according to claim 10, arranged to remove said decorative element from said luminaire wherein;

said electrical wire is removably attached to said at least one electrical connection, and said decorative element is removably attached to said optical structure.

14. A luminaire according to claim 7, further comprising a decorative cover, said decorative cover covering the at least one of a mechanical and electrical connections.

15. A method of installing a luminaire comprising;

installing a base component of a fixing in the desired location, installing one portion of at least one connector to the electrical supply located at the desired location, selecting a decorative element that provides configurable light output characteristics, locating said decorative element proximate to a light engine, securing said decorative element proximate to said light engine using a removably attachable optical structure; wherein the optical structure has a circumference and a protruding, annular portion extending around the circumference; the decorative element comprises a circular hole corresponding to the LED light engine, the circular hole having a diameter larger than a largest diameter of a housing containing said LED light engine and smaller than a diameter of the annular portion; whereby in use, the annular portion supports the decorative element, connecting at least one mechanical and electrical connection at the desired location, covering the at least one connection with a decorative cover.

16. A luminaire according to claim 1 wherein the decorative element is transparent and comprises a micro structure on its inner surface that is designed to reflect the light emitted by the light engine that has passed through the optical structure and is impinging on the decorative element to yield total internal reflection of the impinging light.

17. A luminaire according to claim 1 wherein the optical structure and the decorative element each contribute to producing a flood type beam pattern of light.

* * * * *